US005560625A

United States Patent [19]

Kuykendall

[11] Patent Number: 5,560,625

[45] Date of Patent: Oct. 1, 1996

[54] TRUCK PIECE FOR ATTACHMENT TO INLINE DEVICE

[76] Inventor: DawnMarie D. Kuykendall, 23120 W. Lyons Ave. 5-157, Newhall, Calif. 91321

[21] Appl. No.: 383,934

[22] Filed: Feb. 6, 1995

[51] Int. Cl.[6] ..... A63C 17/26

[52] U.S. Cl. ..... 280/11.22; 280/11.2; 280/11.27; 280/809

[58] Field of Search ..... 280/11.19, 11.2, 280/11.22, 11.23, 11.27, 11.28, 809, 87.041, 87.042; 188/5

[56] References Cited

U.S. PATENT DOCUMENTS 4,273,345 6/1981 Ben-Dor et al. ..... 280/11.22
4,966,377 10/1990 Yu ..... 280/11.22
5,183,276 2/1993 Pratt ..... 280/11.22
5,411,278 5/1995 Wittmann ..... 280/11.27

*Primary Examiner*—Richard M. Camby
*Attorney, Agent, or Firm*—John P. Halvonik

[57] ABSTRACT

A modified truck piece for attachment to a board surface such as a skate board. The truck has two pair of extended ridges each pair having an upper and a lower ridge and each pair running the length of the truck. Skidding pads are attached to the ridges and offer a protective surface covering for the ridges and thus allow the skateboard to be tilted (rolled) to one side or the other with safety. A channel in the bottom of each truck half allows an in line set of wheels to be attached to the underside of the truck piece. The pads may be replaced or reversed as needed.

2 Claims, 2 Drawing Sheets

TRUCK PIECE FOR ATTACHMENT TO INLINE DEVICE

FIELD OF THE INVENTION

The invention relates to the field of inline devices and more particularly to the use of a truck device with skidding surfaces that may be attached to the sides of an in line skateboard in order to allow the skateboard to roll to one side or the other.

BACKGROUND OF THE INVENTION

In line devices are in con, on use today and describe a class of wheeled devices where all the wheels are aligned in a straight line as opposed to e.g. roller skates where the wheels are arranged in pairs. "Roller blades" are a common device in use nowadays that uses in line wheels. Obviously, in line devices are harder to balance than older, roller skate devices, because inline wheels do not support the device upright. The user faust use his own power to balance the device and prevent the device from tipping (rolling) to one side or the other.

While roller blades are, perhaps, the most popular type of inline devices other types are in use. The device described herein is believed to have its greatest utility in connection an inline arrangement of wheels. Such devices have a relatively wide support surface for the user to place both feet. This is similar to the older skateboards, however, the wheels on the underside are all inline. The use of the skid pads described herein allows the user to safely roll and slide the device to one side or the other without causing damage to the support surface.

The term "truck" is used to describe the structure that is attached to the underside of the flat support surface of a skateboard, roller skate, or similar device and supports the wheels. It may be compared to the chassis of an auto. The truck described herein is believed to be novel by itself and may be attached to the undersurface of a board or other type of support surface. The truck is then used to hold a pair of skid pads on each side so that the device may be skidded somewhat in a manner akin to a snow board.

The term "roll" is commonly used to describe one of the movements of an aircraft, among others. The term is used in this specification in a similar manner and describes the tilt of the skateboard left or right from a straight line of movement more or less indicated by the alignment of the in line set of wheels.

It is believed that the invention described herein will likely find the most use in connection with inline skateboards, however the device may be used in connection with other types of inline devices including roller blades, etc. without varying from the spirit of the invention.

PRIOR ART

There are no truck devices known to applicant that have skidding surfaces for attachment to the sides of inline devices.

SUMMARY OF THE INVENTION

A novel truck piece and a novel riding device comprising an arrangement of skidding pads in connection with the truck pieces. The truck is divided into two halves and each has a pair of extended ridges with a central channel between them. Each truck portion is attached to the underside of a skateboard or other type of support surface through bolts that go through the support surface and the truck halves. Each pair of ridges has an upper and a lower ridge and each pair runs the length of the truck on one side of the device. The bottom of the truck portions have a under channel that supports the set of wheels, be they in line or otherwise.

Skidding pads may be attached to each of the ridges via a flange and groove arrangement. The pads offer a protective surface covering for the ridges and thus allowing the skateboard to be tilted (rolled) to one side or the other with safety. The user may then ride the skateboard in a more artistic style by sliding the device along the skids in a direction at an angle to a straight line of movement. The user can roll the device to one side or the other throughout the movement with only the skid pads touching the ground. The pads may be replaced or reversed when they are worn out.

It is among the objectives of the invention to provide a truck piece with skid pads for attachment to the sides of an inline device to provide a surface for frictional contact with the ground or other surface.

Another objective is to provide an in line device with skidding surfaces that may be replaced or reversed as needed.

Another objective is to provide an inline device with the ability to be rolled to one side or the other and thus provide the user with a greater variety of options so as to vary the artistry and skill used in riding inline devices.

Another objective is to provide an inline device with ability to be rolled in one direction or the other without causing undue damage to device or danger to the rider.

Another objective is to provide an inline device that allows the rider to display more varied riding skills by enabling him to safely roll the device in one direction or the other.

Other objectives will become known to those skilled in the art once the invention is shown and described.

DESCRIPTION OF THE PREFERRED EMBODIMENT

Figure 1:
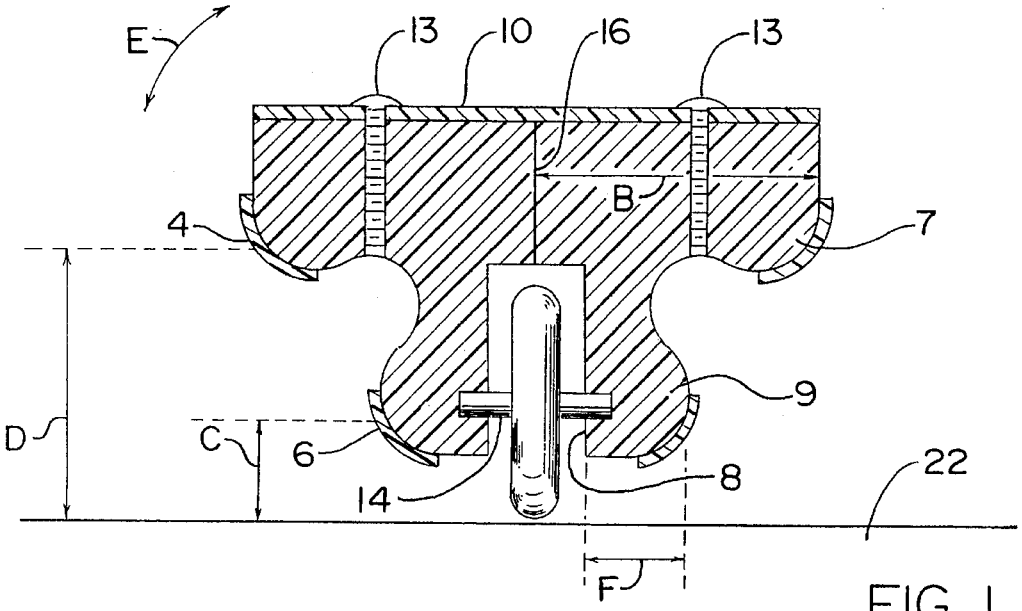
FIG. 1 Side view of inline board and truck.
Figure 2:
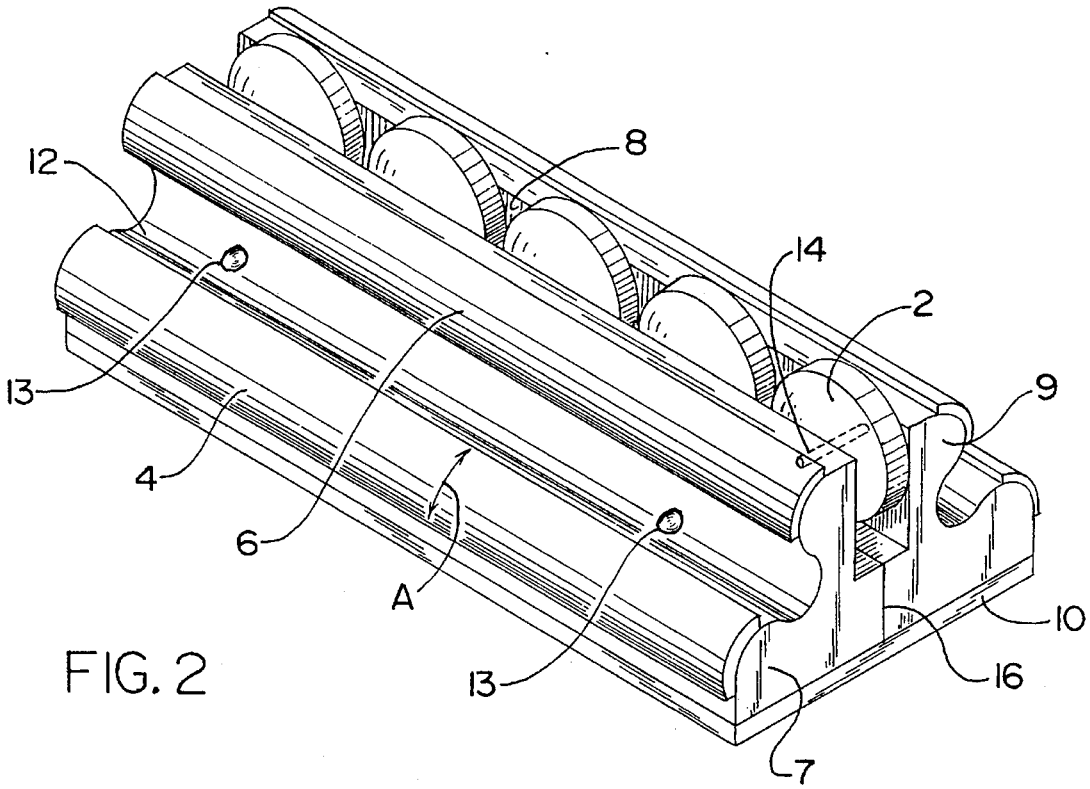
FIG. 2 Perspective view of same.
Figure 3:
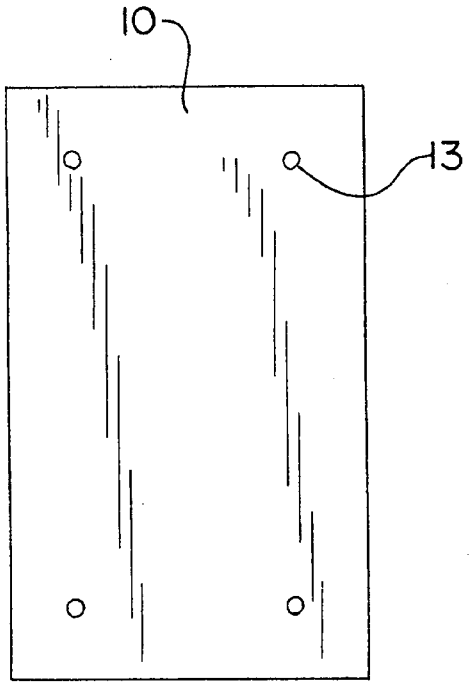
FIG. 3 Top view of board.

The overall construction of the invention is as shown in FIG. 1–2. The typical direction of roll is indicated by arrow E. This is the direction that the user will be able to tilt the device as he rides it. The device includes novel truck sections 7 as well as a novel arrangement of skidding pads 4 and 6 that are connected to the truck halves.

There are two separate truck portions (right and left) and they are divided by the split line 16. Each truck portion may be separately attached to the flat, upper, support surface 10 through the use of bolts 13. The bolts preferably go all the way through to the under surface of the truck where they can be seen in the under channel 8 in FIG. 2. The skid pads 4 and 6 work in conjunction with the truck section and are attached to the upper 7 and lower ridges 9 that run the length of each truck section.

Each truck section has a pair of ridges that run the length of that truck. Each pair is made up of an upper ridge 7 and a lower ridge 9. Each ridge is of a rounded cross section as seen in FIG. 2. A groove or channel 12 runs between the two ridges. The groove serves to separate the two skids from one another so that there will be two separate points of contact (for the two skids on each side) as the device slides along the surface.

Each pair of ridges runs the length of the truck (and hence the length of the skateboard). One pair is on the left and one on the right side of the truck. Each pair has an upper and a lower ridge. The upper side is of course farther from the split line 16 than the lower ridge. This, of course, promotes the roll of the board so that both the upper and lower skids will contact the riding surface at about the same time. The size and orientation of the two ridges (upper and lower) may be varied to enhance the user's ability to tilt the device. The exact orientation and size may be determined by trial and error.

The truck member has an upper surface that would be flush against the underside of the actual riding surface (or upper surface) 10 of the skateboard. The underside of each truck halve forms a channel 8 that runs beneath the truck and supports the arrangement of wheels 2.

The skid surfaces 4, 6 are attached to each of the ridges and allow the device to be rolled in the direction of arrow E and thus the skid surfaces contact the ground 22 or other surface that the device is traveling. The skid pads prevent damage to the device and provide a slick surface on which to slide upon. The use of two skids on each side of the device helps to keep the device in a more or less upright position.

The device travels, initially, in a straight direction in line with the wheels 8. The rider will be able to maneuver the device by rolling or tilting the board in the direction of arrow E and, at the same time, he/she would turn the device to one side as if one were banking into a turn. The device will then slide along the skids at an angle from the straight line of movement. The extent to which the ridges extend from the wheels allow the device to be rolled to a certain extent without tipping the device so far as to cause the rider to fall or otherwise wreck. The skids are likely to rub against the pavement allowing the rider to skid the device across the surface 22.

It is believed that the basic skill maneuver will be a slide to one side along both the upper and lower skid surfaces (both surfaces on the same side/in first one direction and then with the other two skid surfaces on the other side and, in the other direction. The wheels would not contact the surface in this type of slide. This allows the user to perform tricks of agility on the skateboard as well as using a type of movement altogether different from conventional skateboards.

The use of protective shields on the sides of the truck will allow a curved path of movement of the skateboard to be carried out with reasonable safety. It is not the purpose to prevent such sliding movement but, rather, to enhance the use of this maneuver and so lead to more artistic movements. Such movements will require greater skill on the part of the rider and, hence, the sport of inline devices will be graced with more skillful actions.

The skid surfaces may be of replaceable nature so that they can be replaced from the ridges running the length of the truck. They may be removed and replaced by new ones or, they can be simply turned backwards and again placed on the ridges. The skid surface prevents the frictional contact from wearing out or damaging the truck. The skid surfaces should be reasonably slick so that the surface will not "grab" the pavement during a turn and cause the device to turn unnaturally.

It is believed that the invention herein described will have its greatest utility in connection with an inline arrangement of eight wheels 2. However, other arrangements of the wheels on the underside are possible without violating the spirit of the invention. In the arrangement shown here, the wheels are connected to a channel 8 in connection with the underside of each truck section through the use of an axle 14.

However, the use of the truck should not be limited to only an eight wheeled in line skateboard. Other arrangements are possible; for example the board can have two spaces between the forth and fifth wheels thus leaving a gap between the front and rear sets of wheels. Of course, the truck described herein may also be used on other types of inline devices.

It is contemplated that in the preferred embodiment the truck would be attached to the underside of the skateboard by, for example, bolts that are screwed through apertures in the board surface 10 and into the truck. Other arrangements for attaching the truck to the in line device are possible without varying from the spirit of the invention.

Figure 5:
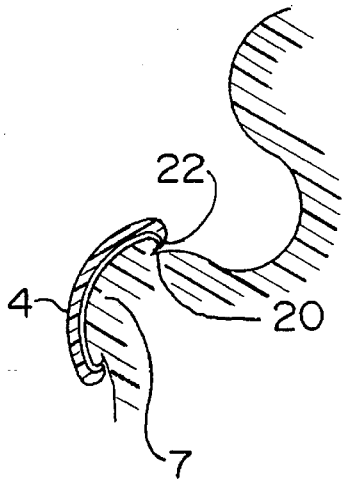
FIG. 5 Detail of flange and slot attachment for skid.
Figure 4:
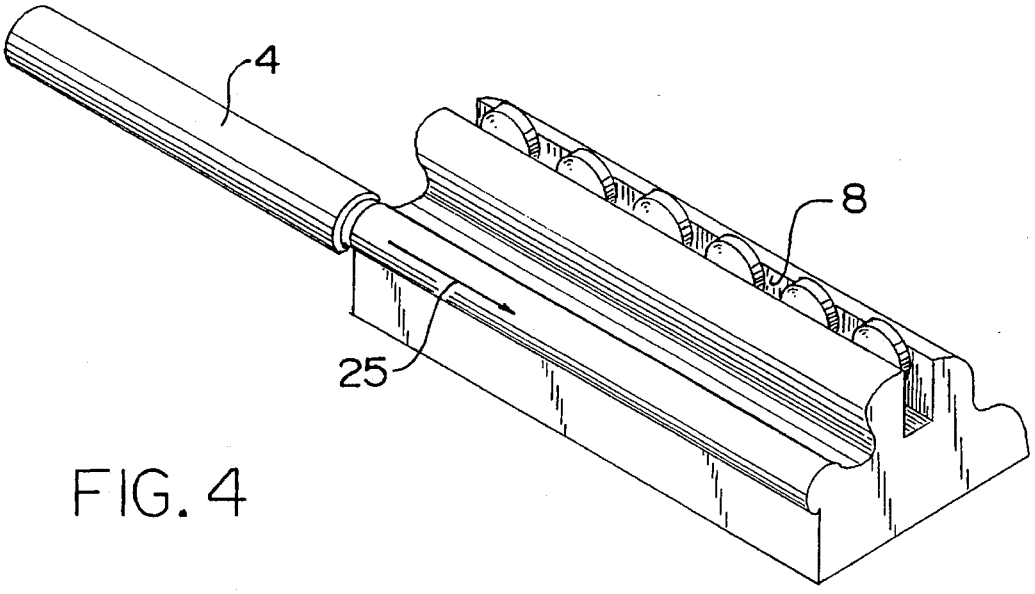
FIG. 4 Underside showing one method of attaching skid.

The skid surfaces may be attached to the ridges by various means. Each skid surface may have an extended portion, or flange 22, on the inner surface which attaches to a corresponding channel portion 20 in the ridge. See FIGS. 4–5.

The skidding surfaces may be attached to the ridges by the resilient nature of the material that the surfaces are made of. The skids may be attached by the channel arrangement. For example, the skidding surface may be squeezed by hand and then fit under channels that run along the ridges or the skids could be slid in the direction of arrow 25 in FIG. 4 in order to secure them to the channel. The resilient nature of the skid surface should keep the surface in connection against the channels.

Other means of attachment are possible without varying from the spirit of the invention. These surfaces may be made of resilient material such as neoprene, etc. Other materials that can resist the effects of skidding (at least for a limited time) may be used without violating the spirit of the invention.

The size of the truck and skids may vary according to the needs of the user. It is thought that the preferred size of the truck would be about 3.5" wide at its thickest portion (line B). The lower ridge may be 1" in width (line F). The height of the assembly as measured from bottom of the wheel to the midline of the upper ridge may be about 2.5" (line C) and the height from the bottom of the wheel to the midline of the lower ridge may be about ¾". The width of the skid is preferably about 1.5".

I claim:

1. A two part truck apparatus for attachment to in line devices, said in line devices having an in line arrangement of wheels and a planar member in connection with said arrangement of wheels, said planar member having a riding surface, an underside and a pair of side edges, the apparatus comprising: a first truck portion having left and right halves, each said half in connection with a central axis, each of said halves having an upper and a lower ridge, each said ridge of rounded cross section and extending from said central axis for a certain extended distance and where said extended distance of said upper ridge is greater than said extended distance of said lower ridge, said truck portion adapted for attachment to said underside of said planar member so that each said upper ridge is in connection with one of said side edges, and a second portion comprising left and right shield members, said shield members having an attachment means for attaching said shield to one of said ridges.

2. The apparatus of claim 1 wherein said upper ridges have a groove and each said shield member is made of a resilient material and said means for attachment comprises a flange adapted for connection to said groove for maintaining said shield in close connection with said ridges.

* * * * *